United States Patent [19]

Taylor et al.

[11] Patent Number: 4,689,895

[45] Date of Patent: Sep. 1, 1987

[54] EVAPORATIVE-COOLING APPARATUS AND METHOD FOR THE CONTROL OF WEB OR WEB-PRODUCTION MACHINE COMPONENT SURFACE TEMPERATURES

[75] Inventors: Bruce F. Taylor, Auburn, Mass.; Kenneth G. Hagen, Cape Elizabeth, Me.

[73] Assignee: Thermo Electron-Web Systems, Inc., Auburn, Mass.

[21] Appl. No.: 834,755

[22] Filed: Feb. 28, 1986

[51] Int. Cl.[4] ..... F26B 7/00

[52] U.S. Cl. ..... 321/20; 34/114; 34/122; 34/155

[58] Field of Search ..... 34/20, 114, 119, 124, 34/122, 155

[56] References Cited

U.S. PATENT DOCUMENTS 2,804,693 9/1957 Brodie ..... 34/122

*Primary Examiner*—L. I. Schwartz

*Attorney, Agent, or Firm*—Pahl, Lorusso & Loud

[57] ABSTRACT

Disclosed is an apparatus for providing a shower of fog onto a web or a machine component in contact with a web. The fog, which has a temperature lower than the temperature of the surface of the web or the machine component to be cooled, is applied to the surface and is caused to evaporate by the difference in the temperatures. A supply of dry air is supplied to transport the evaporated fog from the region surrounding the surface to be cooled. Fog may be generated through the use of an air-atomizing nozzle which propels water and compressed air through a small orifice under pressure to create an atomized mist or fog. The fog may also be generated through the use of an ultrasonic transducer which expels fine droplets of water from its surface by means of a high-frequency oscillating transducer motion. In one embodiment, the fog may also be generated in controlled specified quantities locally at each nozzle as required to provide for a controllable fog application rate across the full apparatus width. Alternatively, the fog may be generated at a single source and then supplied to a common cross-machine plenum with the flow of fog to each nozzle location being regulated by a suitble flow control valve positioned at each nozzle location.

18 Claims, 7 Drawing Figures

EVAPORATIVE-COOLING APPARATUS AND METHOD FOR THE CONTROL OF WEB OR WEB-PRODUCTION MACHINE COMPONENT SURFACE TEMPERATURES

BACKGROUND OF THE INVENTION

This invention relates to papermaking or other industries where a web is produced, and more particularly to an apparatus for cooling the produced web or a machine component in contact with the web.

In the production of webs, such as paper, magnetic tape, laminates, etc., it is often desirable to control the temperature of either the web, or a machine component in contact with the web, for the purpose of controlling certain web properties which are directly or indirectly affected by the temperature of either the web or the machine components in contact with the web. In some cases it is sufficient to control the average temperature of the process component in a uniform cross-machine manner, while in other cases the temperature of the process component must be controlled independently at all points across its width, in suitable cross-machine increments, for the purpose of profiling a given web property which is affected by the temperature control.

At the "dry-end" of the web producing machine, after the dried web leaves the dryer-section, it is typically threaded through a calender-stack. A variation of the temperature profile of the rolls of the calender-stack can be utilized to alter the diameter of the rolls and in turn thereby control the web thickness or caliper profile of the sheet exiting the calender stack.

Typical systems in use today control the surface temperature of rolls of a calender stack by either controlled convective heating or cooling of the roll surface, or inductive heating of the outside radial layer of the roll. With convective heating or cooling, the applied heat-transf.er fluid (typically air) is cooled or heated, respectively after the fluid is applied to the roll surface. To provide for adequate heating or cooling of the roll surface, such systems typically consumed 5 to 10 kilowatts of power per foot, at full output, with resulting efficiencies of 15 to 85 percent, depending upon the system design.

Following the application to the web of coating solutions, ink, laminating glues, or any other externally applied substances used for converting the raw web into a specialized product, it is often desirous to chill or cool the web for the purpose of "setting" or "curing" the applied substance. The web may also be cooled to provide a very thin layer of atmospheric condensation (as exists on a cool substance in a warm humid environment) on the web surface to insure that the coated or otherwise wet surface is mechanically "insulated" during contact with subsequent machine-component surfaces. This action is typically accomplished by the use of a "chilled" roll, which is internally cooled, and which is in physical contact with the web.

The constant contact of the chilled roll with a freshly coated or printed web (or other suitably converted web) may result in the build-up of the previously applied converting substance on the surface of the chilled roll. If such build-up is permitted to continue, the surface residue inevitably mars the passing web and diminishes the quality of the converted product. This surface residue can in some cases be kept to an acceptable level by applying a cleaning-blade or "doctor-blade" against the roll surface, across the full width of the said roll.

Such a cleaning blade scrapes the roll clean as it rotates. However, the resultant contact between the blade and the roll can lead to wearing of the roll surface, which in turn diminishes both the cleaning-performance of the blade and the uniformity of web cooling. In addition, the residue removed by the blade must be evacuated from the blade and its surroundings continuously, an exercise which proves to be difficult in practice.

At various points in the production of a converted or treated web it is necessary to apply precisely metered quantities of liquid suolutions to the surface of the web. In the application of such liquids it has been noted that the absorption properties of certain webs, i.e. the ability of the webs to absorb and retain the applied fluid, is affected by the initial web temperature.

In addition to the temperature related aspects of web production described above, there are a plethora of other process variables which are affected by the web temperature. The drying rate of the web in the dryer section and the compressibility of the web entering the calender-stack (which affects the compression of the web in the calender stack in response to an applied load created by the contact of two calender rolls between which the web passes) are two such variables. The gloss imparted to the sheet through the calender stack is another example of a web temperature-dependent variable. Indeed, each of these variables is dependent upon other machine properties as well, but each variable can nevertheless be controlled to some degree by controlling the web temperature.

At the "wet-end" of the web production process, before the saturated web enters the dryer-section of the machine, the web passes through one or more mechanical presses formed by the contact of two heavily loaded rolls. The function of these mechanical presses is to remove as much water as possible from the web prior to the dryer-section, where the remainder of the web moisture is removed through evaporation. It is known in the art that any method which is capable of positionally altering the water-removal rate through the presses will afford a means to control the initial and hence final web moisture profile.

An accepted method of controlling press water-removal rates is that of web temperature variation. This method is based upon the principle that the water-drainage rate through the web, in the presses, is proportional to and increases with a decrease in web-water viscosity and surface tension, both of which decrease with increasing web temperature. The application of heat to the web by such common means as infra-red heating and steam application, can be use to selectively heat the web and increase the related web water-drainage rate through the presses, thereby affording a measure of web moisture profiling. As would be understood by one skilled in the art, the response, definition, and amplitude of adjustment of any closed-loop mositure control system employing such web heating methods would be improved by the addition of an apparatus capable of selectively cooling the web. In this way it would be possible to selectively heat or cool any position of the web, to the degree desired, thereby improving the performance of the moisture profiling action.

It is therefore a principal object of the present invention to provide an apparatus and method for the non-contact cooling of a web or of machine components in contact with the web.

A further object of the present invention is to provide an apparatus and method for the non-contact cooling of a web or of the machine components in contact with the web through the use of an evaporative cooling technique which may be uniformly executed across the width of the machine or locally executed both with respect to the cross-machine position and magnitude of the cooling applied at the said position.

Another object of the present invention is to provide an apparatus and method for cooling a web or machine components in contact with the web, in a simple efficient manner, which may be enacted uniformly across the machine-width, or sectionally executed in a profiling manner, as required by the specific application.

Still another object of the present invention is to provide an apparatus for the non-contact cooling of a web that may be located above or below the web at any point in the web production process, as required to control the web temperature profile at that point and thereby control a chosen web production variable that is influenced by the web temperature.

It is another object of the present invention to provide an apparatus which can be used to selectively cool and adjust the temperature of a saturated web, through evaporative cooling, in order to control the water-removal rate in the presses.

Yet another object of the present invention is to provide an apparatus which is capable of selectively cooling a web through evaporative-cooling, and which may be coupled with any suitable means capable of selectively heating the web, so as to provide for both selective heating and cooling of the web prior to the mechanical pressing of the web.

It is still another object of the present invention to provide an apparatus and method for selectively cooling by evaporative cooling, any desired portion of a web or mechanical component in contact with the web in the cross-machine direction, so as to allow for the cross-machine control of the temperature profile of the web or mechanical component in contact with the web.

SUMMARY OF THE INVENTION

To accomplish these objects, the present invention utilizes a positionally and magnitudinally controllable evaporative-cooling apparatus to alter the temperature profile of a web being produced or of the surface of one or more calender rolls, (or other suitable machine component in contact with the web) as desired. In the preferred embodiments, the working fluid is chosen as water in a fog form. The fog is applied to the surface to be cooled and evaporated from that surface by virtue of the hotter surface temperature of the web or roll.

The apparatus of the present invention, which will henceforth be referred to as the "Fog-shower", applies a stream of fog against a surface to be cooled. The surface to be cooled must be hotter than the fog, in order to insure that the fog evaporates following contact with the surface. In the process of evaporating, the fog draws heat from the surface, as is required to provide the latent heat of vaporization. The generated vapor resulting from evaporation of the fog is then transported from the region of the apparatus by a supply of cool air whose initial humidity is low enough to allow for the absorption of the evaporated fog. The supply air is supplied at a temperature approximately the same or lower than that of the supplied fog, to insure that the bulk of the heat of vaporization is drawn from the surface to be cooled rather than from the supply-air. Once the heat-transfer coefficient (as applies to the convective boiling heat transfer between the fog stream and the surface) is known, the relative quantites of the fog and supply-air, and their temperatures, can be specified as a function of the temperature of the surface to be cooled, so as to satisfy both the heat and mass transfer conditions.

In order to allow for the selective cooling of the surface in question, the fog is applied through individual nozzles spaced equally across the width of the web production machine. The fog application nozzles are designed so as to allow for the controlled application of fog at each nozzle location. The supply-air, supplied for the purpose of satisfying the mass-transfer conditions in the region between the fog-shower and the surface to be cooled into which the fog is injected, may be selectively applied at each nozzle location or uniformly applied across the whole of the Fog-shower apparatus. Idealy, the full amount of fog injected at each location vaporizes as a result of heat being supplied to the fog from the surface, and the resulting vapor is fully evacuated from the region of the apparatus so as to avoid undesirable recondensing of the vapor in the region of the apparatus. It is of course desirious to simultaneously minimize the amount of energy consumed in the process of providing the supply-air and initially generating the fog.

In one embodiment, the fog is generated through the use of an air-atomizing nozzle which propels water and compressed air through a small orifice under pressure to create an atomized mist or fog. In another embodiment, the fog is generated through the use of an ultrasonic transducer which expels fine droplets of water from its surface by means of a high frequency oscillating transducer motion. The droplets are conveyed to the nozzle exit and finally to the surface to be cooled by a small supply of air introduced just downstream of the ultrasonic transducer.

The fog may be generated in controlled specified quantities locally at each nozzle, as required to provide for a controllable fog application rate across the full apparatus width. Alternatively, the fog may be generated at a single source and then supplied to a common cross-machine plenum with the flow of fog to each nozzle location being regulated by a suitable flow control valve positioned at each nozzle location.

These and other features and objects of the present invention will be more fully understood from the following detailed description of the preferred embodiments which should be read in light of the accompanying drawings in which corresponding reference numerals refer to corresponding parts throughout the several views.

DETAILED DESCRIPTION OF THE PREFERRED EMBODIMENTS

Figure 2:
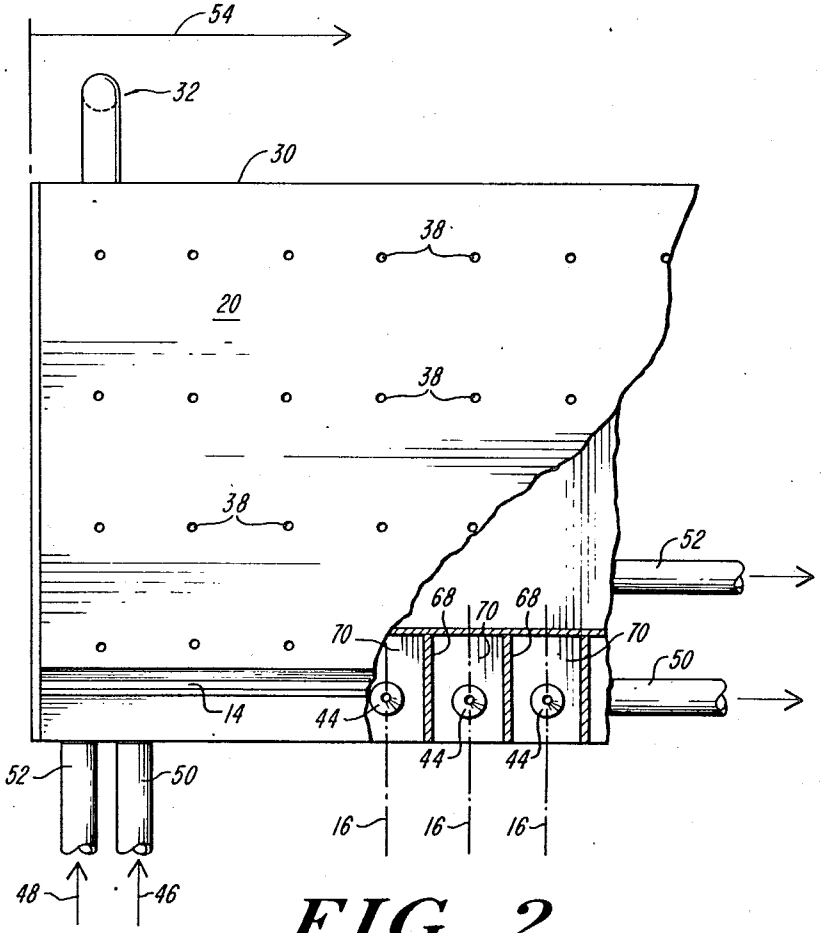
FIG. 2 is a front-elevational view (cross-machine direction) of a sectionalized portion of the embodiment of FIG. 1.
Figure 1:
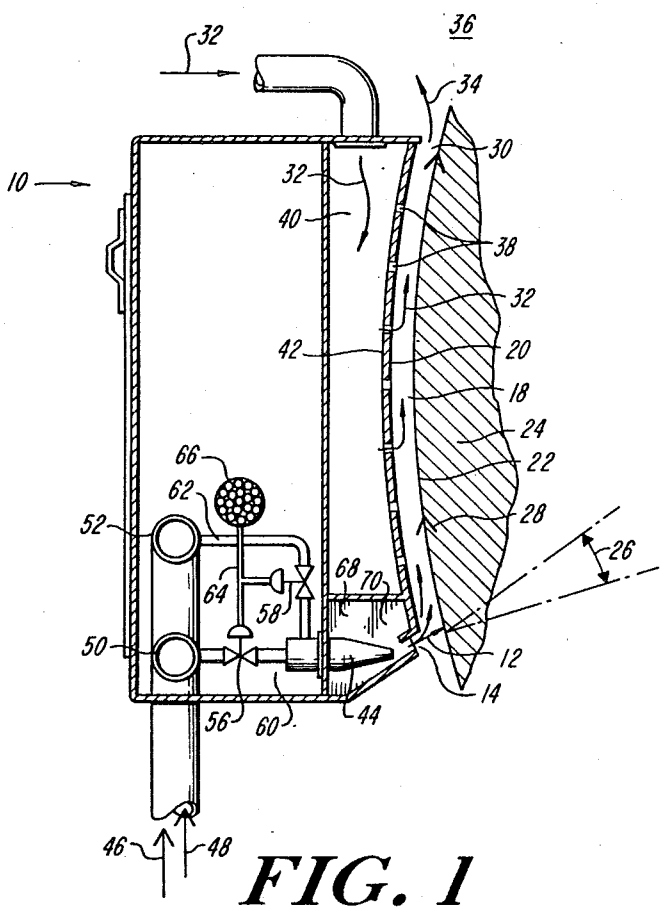
FIG. 1 is a side sectional view of one embodiment of the "fog-shower" apparatus of the present invention, employing an air-atomizing nozzle at each individual control nozzle position.

Referring to FIGS. 1 and 2, a "fog shower" or evaporative cooling apparatus 10 of the present invention is shown which ejects a stream of fog 12 through the exit nozzle slot 14 of the desired nozzle position 16. The fog enters a channel 18 bounded on one side by a face 20 of the apparatus 10 and on the other side by the surface to be cooled 22 (shown in FIG. 1 as a surface 22 of a roll 24). The fog 12 is imparted onto the roll surface 22 by virtue of the fog exit velocity and the angle 26 of the nozzle slot 14 relative to the surface 22. As the roll 24 (or a web, if a web is to be cooled) moves in a direction indicated by arrow 28 toward the exit end 30 of the channel 18 of the apparatus 10, the applied moisture layer that results from application of the fog 12 to the roll surface 22 is exposed to dry air 32 supplied to the channel 18.

The hotter temperature of the roll surface 22 evaporates the cooler moisture layer formed by the application of the fog, and the resulting vapor is absorbed by the dry air 32 supplied to the channel 18. The roll surface 22 is subsequently cooled by the evaporative process, while the resulting moist air 34 is evacuated from the channel 18 by the movement of the roll surface 22 towards the exit end 30 of the apparatus 10. In essence, the moist air is being pumped from the region between the apparatus 10 and the roll 24 where it exhausts to the ambient atmosphere 36. The dry air employed for the purpose of transporting the vapor away from the process is fed to the channel 18 by a suitable array of air nozzles 38 in the face 20 of the apparatus. In the embodiment shown, the air nozzles 38 are round orifices in the face 20. The dry-air 32 is supplied to the orifices 38 by a cross-machine distribution plenum 40, the outboard wall 42 of which forms a portion of the unit face 20.

The fog applied at the nozzle location 16 is generated through the use of an air-atomizing nozzle 44 located at the nozzle location 16. Compressed-air 46 and low pressure water 48 are supplied to each air-atomizing nozzle 44 by compressed-air distribution header 50 and water distribution header 52 respectively. These headers 50, 52 traverse the full width 54 of the apparatus 10. The amount of fog generated by each air-atomizing nozzle 44 is regulated by compressed-air valve 56 and water control valve 58, located in the compressed air feed pipe 60 and water feed pipe 62, respectively, between the respective distribution headers 50, 52 and the air-atomizing nozzle 44. The two control valves 56, 58 may be any known type of valve that will enable the valves 56, 58 to operate in tandem in response to a pneumatic or electric signal 64 which is conveyed to the control valves 56, 58 by a cross-machine pneumatic-signal or electric signal conduit 66. The pneumatic or electric signal 27 conveyed to each pair of control-valves 56, 58 at each nozzle position 16 is remotely generated by either a manual or computer control station.

The apparatus described above allows a stream of fog 12 to be selectively generated at any nozzle location 16 in varying quantities. Baffle-plates 68 located between adjacent nozzle chambers 70 insure that fog 12 generated at a given nozzle location 16 is prevented from bleeding into adjacent nozzle chambers 70 prior to its final application to the surfaces to be cooled at the desired cross-machine roll or web location.

Assuming that the fog utilized by the present invention can be generated in a simple manner requiring negligible power consumption, the latent heat content of the fog is capable of providing approximately 10 kw of cooling with an attendant water consumption rate of only 0.07 gallons per minute, based on the assumption that 100 percent of the absorbed heat of vaporization is supplied by the roll. Of course, even a relatively low percentage of evaporation can be understood to provide concentrated cooling which is relatively inexpensive to produce, considering the negligible cost of water.

Figure 3:
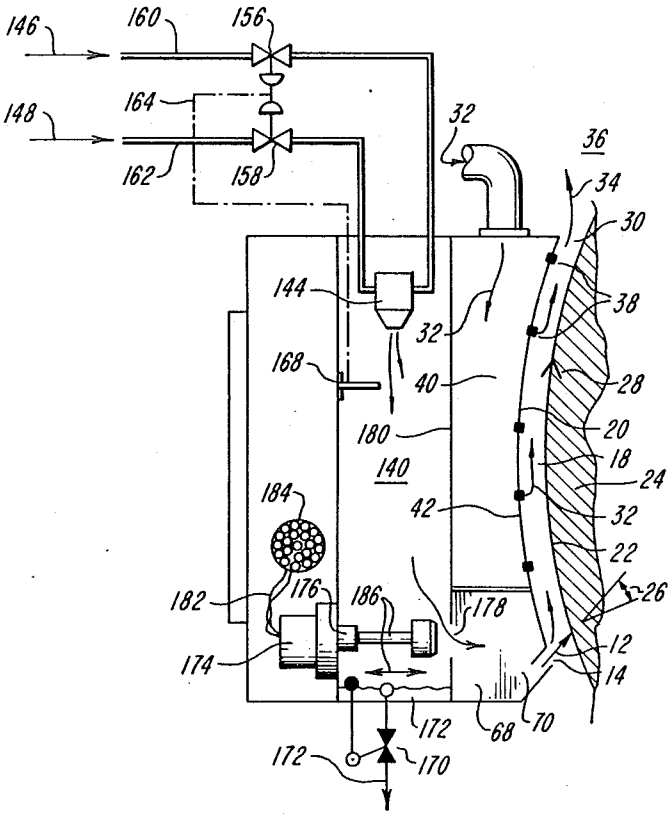
FIG. 3 is a side-sectional view of an embodiment of the fog-shower apparatus, employing one air-atomizing nozzle for the whole fog-shower apparatus, and a suitable flow control-valve at each individual control nozzle position.

Referring to the alternate embodiment of the present invention shown in FIG. 3, the apparatus 10, as in the embodiment of FIG. 1, is shown adjacent a roll 24. The apparatus shown in FIG. 3 operates in a manner similar to that of the apparatus of FIG. 1, and the following description will describe those elements of the apparatus shown in FIG. 3 which have not been described with reference to FIG. 1.

One air-atomizing nozzle 144 of a size and design considered sufficient to generate the total stream of fog 12 required by the fog-shower apparatus 10 is installed within a common cross-machine fog distribution plenum 140. Compressed-air 146 and low-pressure water 148 are supplied to the air-atomizing nozzle 144 through compressed-air feed-pipe 160 and low-pressure water feed-pipe 162, respectively. On-off shut-off valves 156, 158, located in the respective feed-pipes, open and close the compressed-air and water supplies to the air-atomizing nozzle 144 in response to a plenum pressure signal 164. This plenum pressure signal 164 insures that the pressure within the fog distribution plenum 140, and hence the fog volume within the plenum 140, is maintained at an adequate level. The plenum pressure signal 164 may be generated and conveyed to the respective valves 156, 158 by means of a pressure transducer/sensor 168 emitting either an electrical, pneumatic or hydraulic output 164, which is proportional to the sensed plenum pressure. The emitted signal may be used to open and close the respective shut-off valves 156, 158 either directly, as in the case of a pneumatic or hydraulic transducer output, or indirectly using a current-over-air converter which would convert an electrical transducer output to a pneumatic counterpart as required to facilitate straight-forward opening and closing of the shut-off valves. Of course, any other known means device may be used to maintain the proper pressure within the fog distribution chamber 140.

In order to eliminate the passage of large water droplets through the exit nozzle slot 14, a float-actuated drain-valve 170 is employed on the bottom of one end of the fog distribution plenum 140. Drain valve 170 insures the adequate removal of any collected water 172. It may be understood that considering the low cost of such fog generation, a constant fog stream may be generated without the aid of the above pressure control circuit, with unused fog being allowed to simply condense and drain away as required.

In the embodiment of FIG. 3, nozzle control valves 174 facilitate the selective application of fog 12 (i.e. the positional and volumetric application of fog) at any desired nozzle position 16 across the apparatus 10. The nozzle control valves 174 may be, for example, electrically actuated stepping-motors with incorporated lead-screw devices 176. The nozzle control-valve 174 spans the plenum 140 and closes off a plenum orifice 178 located in the plenum wall 180 at each nozzle location. It is through orifices 18 that the fog exits from the plenum 140 into the individual nozzle chamber 70 of the respective nozzle location 16. The nozzle control-valve 174 is positionally controlled by an electrical signal 182 conveyed to the valve 174 by a cross-machine control signal conduit 184. The varying of the shaft extension 186 of the nozzle control-valve 174 regulates the percentage of open-area of the plenum orifice 178 at the related nozzle position 16, thereby regulating the flow of fog under a constant plenum pressure to the final application at the nozzle position 16.

Figure 4:
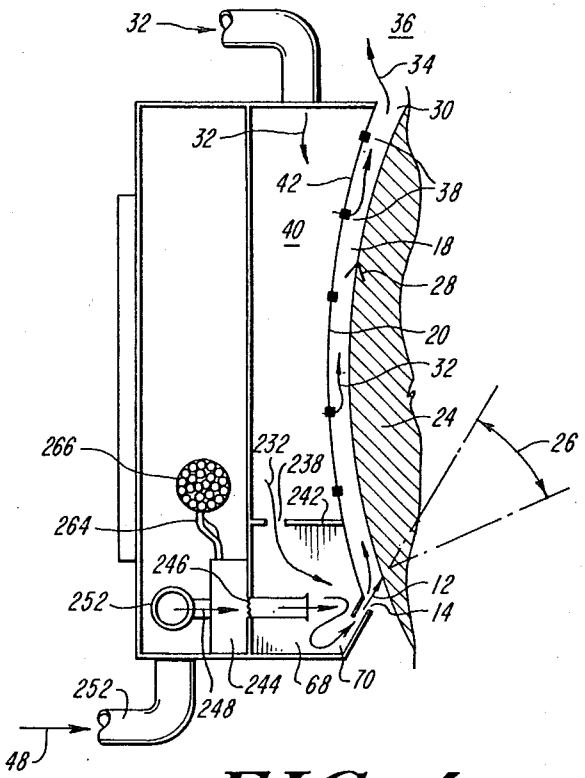
FIG. 4 is a side-sectional view of an alternate embodiment of the fog-shower apparatus of the present invention, employing an ultrasonic transducer at each individual control nozzle position.

Referring to FIG. 4, another alternate embodiment of the present invention is shown which includes an apparatus 10, similar to the apparatus 10 shown in FIGS. 1 and 3, positioned adjacent a roll 24. This apparatus operates in a manner similar to the FIG. 1 and 3 embodiments described above, and the following description will be directed towards those elements of the apparatus shown in FIG. 4 which have not been described with reference to the embodiments of FIGS. 1 and 3.

At each nozzle location 16, fog 12 is generated by an ultrasonic transducer 244 which is fed by a water-supply distribution header 252 spanning the full width 54 of the apparatus 10. The ultrasonic transducer 244 generates fog by expelling small droplets of water from the surface of the transducer 244 as a result of a low water pressure in the water distribution header 252. The small droplets are created through the high frequency oscillation of the transducer membrane 246. The quantity of water expelled by the transducer 244, and hence the volume of fog generated, may be controlled by either a controlled restriction of the water flow 248 to the transducer 244 or by variation of the transducer frequency and/or oscillation amplitude. In the latter case, a fixed water-flow 248 is supplied to the ultrasonic transducer 244, while a variable amount is consumed. Consequently, bleed holes (not shown) are positioned around the periphery of the transducer housing to drain excess water into a common, cross-machine collection manifold (not shown), to a common drain external to the fog-shower apparatus 10.

Although the axis of the ultrasonic transducer 244 is indicated in the drawing in a horizontal orientation, such nozzles must typically be positioned in such a way as to maintain the transducer surface 246 in a true horizontal position, a requirement which is easily satisfied. If required, the ultrasonic transducer oscillations can be controlled by electrical means in response to an electrical signal conveyed through lines 264 to the nozzle through the cross-machine electrical signal conduit 266. Once the fog is generated by the ultrasonic transducer 244, it is conveyed through the exit-nozzle slot 14 corresponding to the related nozzle position 16 by a flow of air 232 bled into the nozzle chamber 70 from the cross-machine dry-air supply plenum 40. The flow of air 232 enters the specific nozzle chamber 70 through a fixed orifice 238 in the wall 242 separating the air-supply plenum 40 and the said nozzle chamber 70. Preferably, one such orifice is provided for each nozzle position 16 to provide fog to the final application at any given nozzle position 16.

Figure 5:
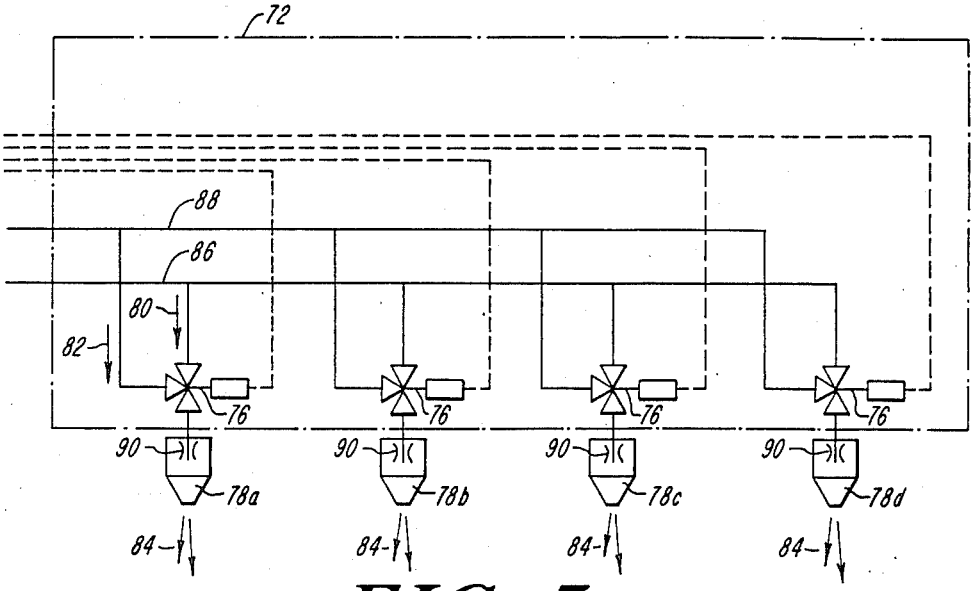
FIG. 5 is a schematic view of a fog-generating nozzle, comprising four separate air-atomizing nozzles, which would typically be employed at each control-nozzle position.
Figure 6:
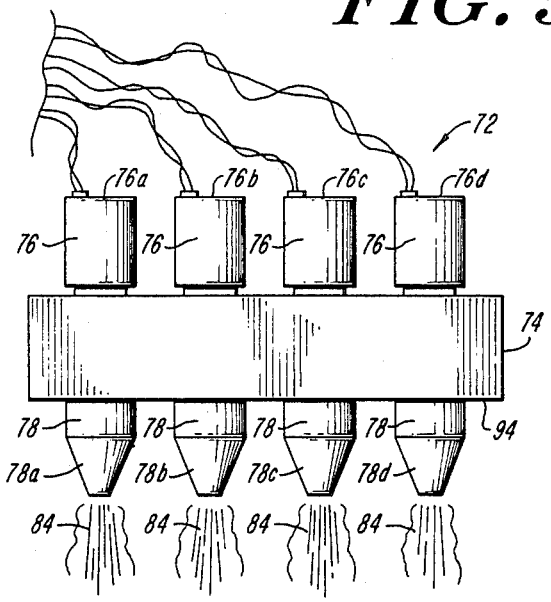
FIG. 6 is a top plan view of the fog-generating nozzle of FIG. 5.
Figure 7:
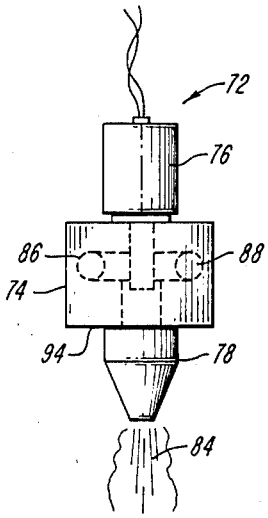
FIG. 7 is a side plan view of the fog generating nozzle of FIG. 6.
Figure 9:
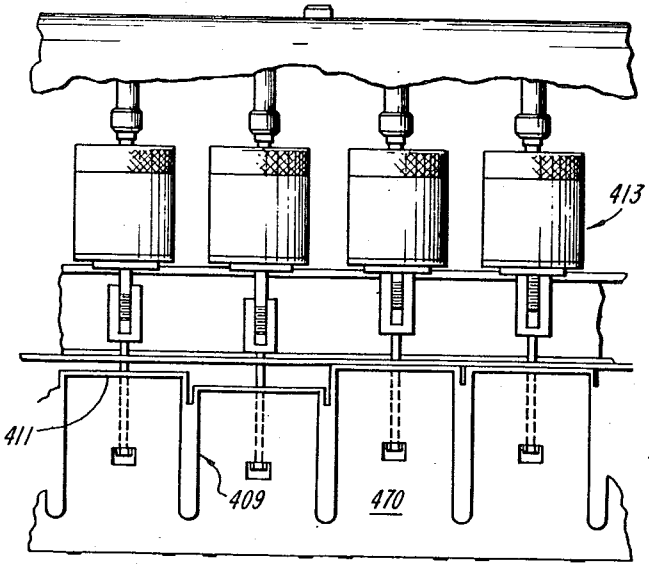
Figure 8:
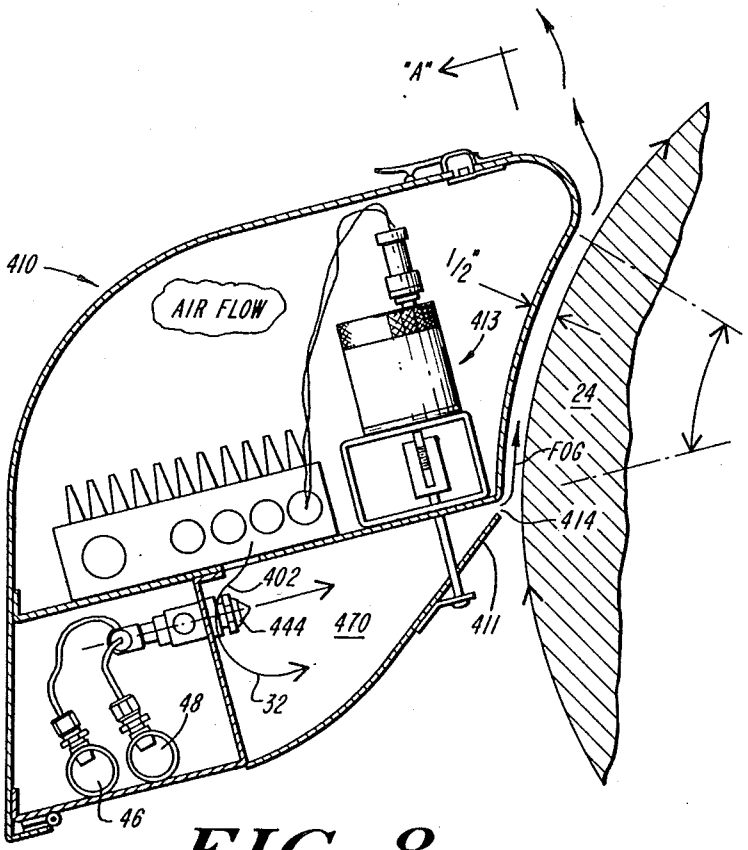
Figure 10:
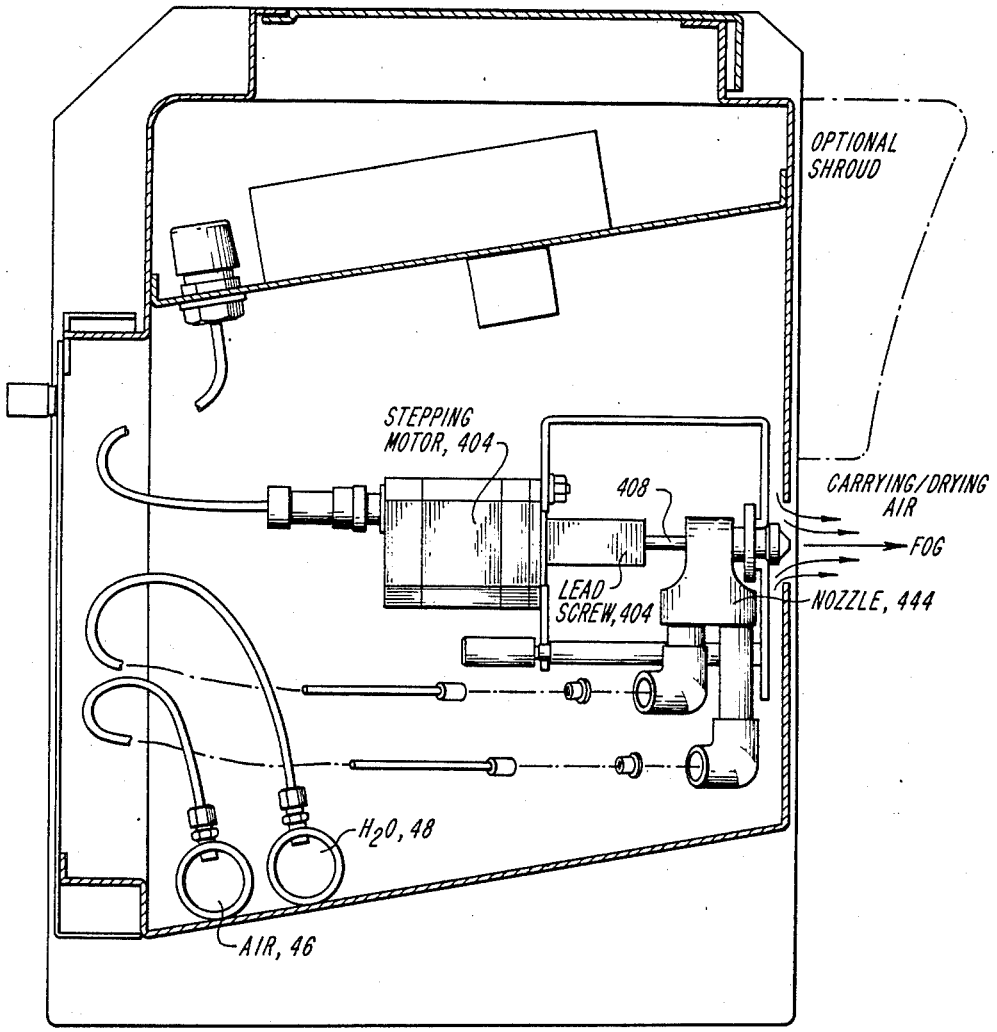

An additional embodiment of the present invention shown in FIGS. 5–7 provides an alternate means for providing locally controlled and generated fog at each nozzle position 16. In an apparatus as described with reference to the embodiment of FIG. 1, separate compressed-air feed pipe 60 and water feed pipe 62 would connect the respective distribution headers directly to the fog generating nozzle 72 shown in FIGS. 5–7. One such fog generating nozzle 72 is provided for each nozzle location 16. Each fog generating nozzle 72 includes a machined nozzle block 74 of brass or other suitable material each of which comprises four solenoid valves 76 (76*a*–76*d*) and four air-atomizing nozzles 78 (78*a*–78*d*). The energizing of a solenoid 76 mounted co-axially with its respective air-atomizing nozzle 78 permits the flow of compressed-air and water through the respective air-atomizing nozzle 78 to generate fog. The four air-atomizing nozzles 78 would be supplied by common compressed-air header 86 and common water distribution header 88 within the nozzle block 74. Headers 86, 88 are connected, for the purpose of supply, to the respective cross-machine distribution headers 50, 52. The four air-atomizing nozzles 78 would be selected with orifices 90 of a size sufficient to insure that the fog flow-rate 84 through each nozzle 78 is twice the flow-rate through the previous nozzle 78. As a result, one unit of flow is provided by air-atomizing nozzle 78*a*, two units of flow by air-atomizing nozzle 78*b*, four units of flow by air-atomizing nozzle 78*c* and eight units of flow by air-atomizing nozzle 78*d*. By energizing the related four solenoids 76 in specific combinations, it is possible to provide sixteen equal flow increments (including zero) at any nozzle position 16, thereby providing proportional fog flow control at each nozzle position. The lower surface 94 of the fog generating nozzle 72 would be mounted flush against the back wall of the nozzle chamber 70 so that the four fog generating nozzles 78 would protrude into the nozzle chamber 70. The total volume of fog generated by nozzles 78 is conveyed through the nozzle slot 14 at the respective nozzle location 16 for final application to the process.

In each of the above-described embodiments, the apparatus of the present invention is shown parallel to a roll surface such as a calender roll, but it should be appreciated that the apparatus could similarly be installed parallel to any machine component in contact with the web, or the web itself, requiring only that for certain applicatons the front face of the apparatus be flat rather than curved as required in the former case.

While the foregoing invention has been described with reference to its preferred embodiments, various alterations and modifications will accur to those skilled in the art. For example, any means for generating, applying and exhausting the required fog may be utilized in the present invention. The preferred embodiments discussed above include a cross-machine row of independent fog-generating nozzles, or a single fog-generating nozzle operating in concert with suitable flow-metering valves at each cross-machine position. In addition, either a cross-machine row of control-locations, for the selective cross-machine application of fog to the process, or a single full machine-width "nozzle" consisting of a single slot or row of holes may also be employed for uniform full machine-width cooling. The dry-air required to satisfy the mass-transfer criteria may be supplied to the apparatus through an array of holes or slots (Coanda type or other), either upstream or downstream of the fog exit-nozzle. The fog itself may be supplied to the process in a direction either parallel to the surface to be cooled in a counter or co-flow direction, or normal to the surface, or at any angle of impingement between the two extremes. The fog exit-nozzle may also be of the slot type described above or of a hole or slot-array type. These and other such alterations and modifications are intended to fall within the scope of the appended claims.

What is claimed is:

1. An apparatus for use in the non-contact cooling of a web or a machine component in contact with a web, said apparatus being positioned adjacent said web or component to be cooled, said apparatus comprising:

means for creating fog within said apparatus, said fog having a temperature lower than the temperature of said web or component to be cooled;

means for directing said created fog from said apparatus into a channel between said apparatus and the web or machine component, said directing means providing said fog to said channel so that said fog is applied to the surface of said web or machine component;

means for exhausting vapor from said channel, said vapor being created by the contact of said fog with said surface which causes evaporation of said fog, said exhausting means preventing the residual build-up of mositure on said web or machine component.

2. The apparatus for use in the non-contact cooling of a web or a machine component in contact with the web of claim 1 wherein said means for creating fog comprises:

compressed-air supply means and compressed air supply valve means connected to said compressed-air supply means for controlling the release of compressed air from said compressed-air supply means;

water supply means and water supply valve means connected to said water supply means for controlling the release of water from said water supply means;

air-atomizing nozzle means for receiving compressed air from said compressed air supply means and water from said water supply means, said air-atomizing nozzle means providing a flow of fog to a chamber in said apparatus.

3. The apparatus for use in the non-contact cooling of a web or a machine component in contact with the web of claim 2 wherein said directing means comprises an opening in said apparatus, said opening including a passageway through which fog is forced from said chamber into direct contact with the surface to be cooled.

4. The apparatus for use in the non-contact cooling of a web or a machine component in contact with the web of claim 1 wherein said means for exhausting vapor comprises:

means for supplying dry-air to a plenum chamber located within said apparatus at a position adjacent said channel between said apparatus and said surface to be cooled;

at least one orifice in the face of said plenum chamber adjacent said channel, said at least one orifice allowing said dry air to enter said channel from said plenum chamber to transport vapor, created by the application of fog to said surface to be cooled, from said channel.

5. The apparatus for use in the non-contact cooling of a web or a machine component in cotnact with the web of claim 1 further comprising a fog chamber into which the created fog is supplied, said fog building up a pressure within said chamber.

6. The apparatus for use in the non-contact cooling of a web or a machine component in contact with the web of claim 5 wherein said fog chamber comprises at least one baffle plate for dividing said fog chamber into at least two fog chambers, each of said fog chambers applying fog only to a portion of the web or component be cooled adjacent said one of said at least two fog chambers.

7. The apparatus for use in the non-contact cooling of a web or a machine component in contact with a web of claim 1 wherein said means for creating fog comprises:

a cross-machine fog distribution plenum for storing a supply of fog;

compressed-air supply means and compressed-air supply valve means connected to said compressed-air supply means for controlling the release of compressed air from said compressed air supply means;

water supply means and water supply valve means connected to said water supply means for controlling the release of water from said water supply means;

air-atomizing nozzle means for receiving compressed air from said compressed-air supply means and water from said water supply means, said air-atomizing nozzle means providing a flow of fog to said fog distribution plenum;

pressure detecting means for detecting fog pressure within said fog distribution plenum and for supplying a signal to control said compressed-air supply valve means and said water supply valve means to maintain pressure at a desired level.

8. The apparatus for use in the non-contact cooling of a web or a machine component in contact with a web of claim 7 wherein said apparatus further comprises means for conveying said supply of fog to said means for directing said created fog, said means for conveying fog including an orifice in a wall of said fog distribution plenum which leads to said means for directing said created fog, the percentage of said orifice open to said plenum being controlled by an orifice-control means which controls the volume of fog conveyed to said means for directing said fog.

9. The apparatus for use in the non-contact cooling of a web or a machine component in contact with a web of claim 1 wherein said means for creating fog comprises:

ultrasonic transducer means having a transducer membrane capable of high-frequency oscillation;

water supply means for supplying water to said transducer membrane, said transducer membrane expelling small droplets of water which impinge the surface of the membrane, said droplets being conveyed to said means for directing said fog.

10. The apparatus for use in the non-contact cooling of a web or a machine component in contact with the web of claim 2 wherein said air-atomizing nozzle means comprises:

a fog-generating nozzle including at least two solenoid valves and associated air-atomizing nozzles mounted coaxially with said solenoid valves, each of said associated air-atomizing nozzles having exit orifices different than the diameter of any other of said at least two air-atomizing nozzles so that the flow rate through each nozzle differs from the flow rate through any other of said at least two air-atomizing nozzles.

11. A method for the non-contact cooling of a web or a machine component in contact with a web, said method comprising the steps of providing a channel bounded on one side by a surface of the web or machine component in contact with the web to be cooled;

creating a supply of fog, the temperature of which is lower than the temperature of the web or component to be cooled;

directing fog from said created supply of fog to the surface to be cooled which bounds one side of said channel;

exhausting vapor created by evaporation of said fog which is caused by the contact of fog and the surface of the web or machine component to be cooled from said channel to an ambient atmosphere.

12. The method for the non-contact cooling of a web or a machine component in contact with the web of claim 11 further comprising the steps of positioning a housing having a surface complimenting the surface to be cooled adjacent said channel, said complimenting surface bounding a second side of said channel.

13. The method for the non-contact cooling of a web or a machine component in contact with the web of claim 12 further comprising the steps of:

providing a means for creating fog within said housing;

directing said fog from said fog supply through a passageway in said housing, said passageway leading to a surface of said web or component to be cooled.

14. The method for the non-contact cooling of a web or a machine component in contact with the web of claim 11 wherein said step of exhausting vapor comprises forcing dry air through an orifice in said complimenting surface and into said channel, said dry air transporting said vapor from said channel thereby exhausting said vapor from said channel.

15. The method for the non-contact cooling of a web where a machine component in contact with the web of claim 11 further comprising the step of directing fog from said created supply at discrete locations across a width of said apparatus.

16. The method for the con-contact cooling of a web or a machine component in contact with the web of claim 11 further comprising the step of volumetrically controlling the fog directed from said created supply of fog to the surface to be cooled.

17. An apparatus for use in the non-contact cooling of a web or a machine component in contact with the web, said apparatus being positioned adjacent said web or component to be cooled, said apparatus comprising:

means for creating fog within said apparatus, said fog having a temperature lower than the temperature of said web or component to be cooled;

means for directing said created fog from said apparatus to a surface of the web or machine component;

means for exhausting vapor from a location adjacent said surface of the web or machine component, said vapor being created by the contact of said fog with said surface which causes evaporation of said fog, said exhausting means preventing the residual build-up of moisture on said web or machine component.

18. A method for the non-contact cooling of a web or a machine component in contact with a web, said method comprising the steps of creating a supply of fog, the temperature of which is lower than the temperature of the web or machine component to be cooled;

directing fog from said created supply of fog to a surface to be cooled;

exhausting vapor, created by evaporation of said fog which is caused by the contact of fog and the surface of the web or machine component to be cooled, from a location adjacent a surface to be cooled to an ambient atmosphere.

* * * * *